US006976379B2

(12) United States Patent
Drigani et al.

(10) Patent No.: US 6,976,379 B2
(45) Date of Patent: Dec. 20, 2005

(54) DEVICE TO VARY THE POSITIONING OF THE ROLLING ROLLS FOR PLANE PRODUCTS

(75) Inventors: Fausto Drigani, Pozzuolo del Friuli (IT); Stanislaw Pawlowski, Mulheim an der Ruhr (DE); Enrico Ventulini, Nespoledo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 285 days.

(21) Appl. No.: 10/381,104

(22) PCT Filed: Sep. 24, 2001

(86) PCT No.: PCT/IB01/01737

§ 371 (c)(1),
(2), (4) Date: Mar. 21, 2003

(87) PCT Pub. No.: WO02/24356

PCT Pub. Date: Mar. 28, 2002

(65) Prior Publication Data

US 2003/0188560 A1 Oct. 9, 2003

(30) Foreign Application Priority Data

Sep. 25, 2000 (IT) ..... UD2000A0177

(51) Int. Cl.[7] ..... B21B 31/16

(52) U.S. Cl. ..... 72/241.8; 72/237

(58) Field of Search ..... 72/237, 245, 241.8; 100/158 R

(56) References Cited

U.S. PATENT DOCUMENTS

| | | | |
|---|---|---|---|
| 4,348,952 | A | 9/1982 | Gooch |
| 5,924,319 | A | 7/1999 | Ginzburg |

FOREIGN PATENT DOCUMENTS

| | | | |
|---|---|---|---|
| JP | 57195513 | | 12/1982 |
| JP | 05-277528 | * | 10/1993 |
| JP | 05277525 | | 10/1993 |
| JP | 05317933 | | 12/1993 |
| JP | 10-175006 | * | 6/1998 |

* cited by examiner

*Primary Examiner*—Lowell A. Larson
(74) *Attorney, Agent, or Firm*—Stevens, Davis, Miller & Mosher, LLP

(57) ABSTRACT

A device to vary the positioning of a rolling roll for plane products, comprising a housing able to support the roll and the respective chocks thereof. On the crossing plane of the roll and at the two sides of every chock a drawing sector is provided for cooperating with drive means, and a transmitter element is present in an intermediate position to achieve an oscillating connection between the drawing sector and the drive means, which are associated with position transducer means and data processing means.

15 Claims, 3 Drawing Sheets

DEVICE TO VARY THE POSITIONING OF THE ROLLING ROLLS FOR PLANE PRODUCTS

FIELD OF THE INVENTION

The invention concerns a device to vary the positioning of the rolls, that is, crossing the rolls in a rolling stand for plane products, such as sheets, large plates or similar.

BACKGROUND OF THE INVENTION

In the state of the art, a problem which has not been correctly solved is that the drawing sectors are not displaced congruently, according to corresponding points, with the drawing sectors of the chock if the axes remain correspondent.

JP-A-57195513 discloses a device to perform a cross section of rolls smoothly, by providing chock holding devices to both sides of the roll chocks along a rolling direction and by rocking both rocking pieces of the devices to opposite directions by equal quantities respectively by making the eccentric pins as the rocking centers. In particular, two jacks are actuated respectively in opposite directions by equal quantities. At the side of a first jack, the movement of the latter is transmitted to a corresponding eccentric pin through a slide block, a link, a lever, and a rotary shaft; at the side of a second jack, the movement of it is transmitted to another corresponding eccentric pin in the same manner. Accordingly the two eccentric pins are rotated respectively in opposite directions by equal quantities to move rocking pieces in opposite directions by equal quantities respectively. Against the movements of such rocking pieces at an operation side, rocking pieces at a driving side move reversely to the operation side, and in opposite direction by the same quantity respectively in order to make the roll axis cross an horizontal imaginary line which intersects the rolling direction perpendicularly. This known device is complicated and cumbersome due to the use of eccentric means.

SUMMARY OF THE INVENTION

The invention is intended to solve this problem and to supply other advantages.

With the inventive idea of this invention, the displacements of the drawing sectors are congruent, for corresponding points, with those of the chocks (same axis of rotation). The action of the bending means of the rolls, both in and out, on the wings of the chocks, is exerted in the same position for any value whatsoever of the crossing angle $\alpha$.

In this way there is no relative sliding between the bending rolls and chock, during the movement caused by a variation in the crossing angle $\alpha$. This also allows to maintain the bending load at very high values, during said movement. As can be seen in FIGS. 2*a* and 2*b*, despite the variation in the crossing angle $\alpha$, the relative position of the bending rolls with respect to the chock remains the same. Each bending roll is not therefore subject to thrusts perpendicular to its axis, caused by friction; it is therefore possible to have:

a high level of bending during the variation in the crossing angle $\alpha$;

greater reliability of the whole mechanism of the bending rolls;

shorter bending rolls, with less vertical bulk, as it is not necessary to have a long "guide" to support the torque generated by $\mu F_{bending} \cdot b$ (FIG. 3), since said torque is nil, since $\mu F_{bending}$ is equal to zero when there is no movement between chock and bending rolls.

The drive means are arranged both on the side of the operator and on the command side on the outer faces of the housings, so that there is no bulk on the extrados of the housings; this bulk would complicate access to the inter-stand, particularly in the case of a tandem positioning with two or more stands.

The multiplier effect of the transmitter element allows to vary the crossing angle under load, with limited dimensions of the drive means.

The reversible kinematism prevents movement from being blocked in the event of a malfunction of the line transducers or the control system which processes a geometric model of the kinematism, to give the position references to the actuator, which can be electric, electro-mechanical or hydraulic. The reversible kinematism allows to prevent the mechanism from blocking and consequent anomalous overloads between the different elements of the mechanism.

The friction load on the kinematic chain has a deadening effect on any possible vibrations which, without said friction, could occur on the horizontal plane too, induced by the rolls connected to the chocks.

The independent drive of the four sectors, two on the operator side and two on the engine side, allows to make the roll change with an adequate play between chock and stand housing.

According to the invention, the two chocks are made to cooperate, on the crossing plane, with two plus two drawing sectors.

Said two plus two drawing sectors are located respectively one upstream and one downstream of the specific chock.

Each drawing sector moves in linear fashion and is connected by means of a transmitter element to a substantially linear drive and feed means. According to a variant, the drawing sector moves in a curve.

The axis of displacement of said drive means is substantially parallel to the nominal axis of the roil.

According to a variant, said axis of displacement is angled with respect to said nominal axis.

According to another variant, the feed of the drive means determines a trajectory with a linear-curved path.

According to the invention, the transmitter element is a tie-strut element.

The axis of said tie-strut element is inclined on the crossing plane with respect to the normal to the nominal axis of the roll.

BRIEF DESCRIPTION OF THE DRAWINGS

These and other characteristics of the invention will become clear from the following description of a preferred form of embodiment, given as a non-restrictive example with reference to the attached drawings wherein.

DETAILED DESCRIPTION OF A PREFERRED EMBODIMENT

We shall now describe, with reference to the attached Figures, a practical embodiment of the inventive idea, given as a non-restrictive example.

Figure 1:
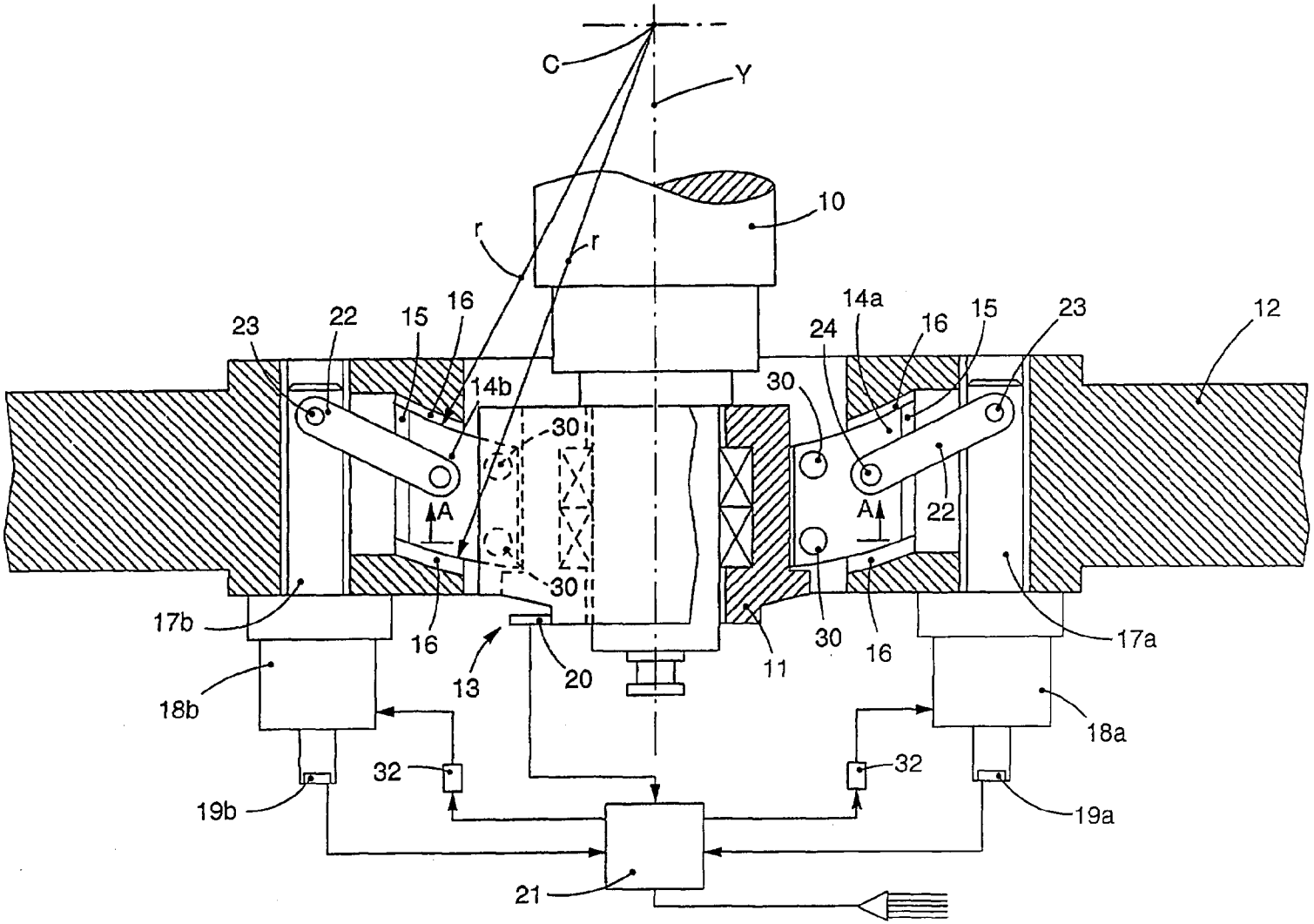
FIG. 1 is a partly sectioned view from above of the device to vary the positioning of the rolls according to the invention.
Figure 2A:
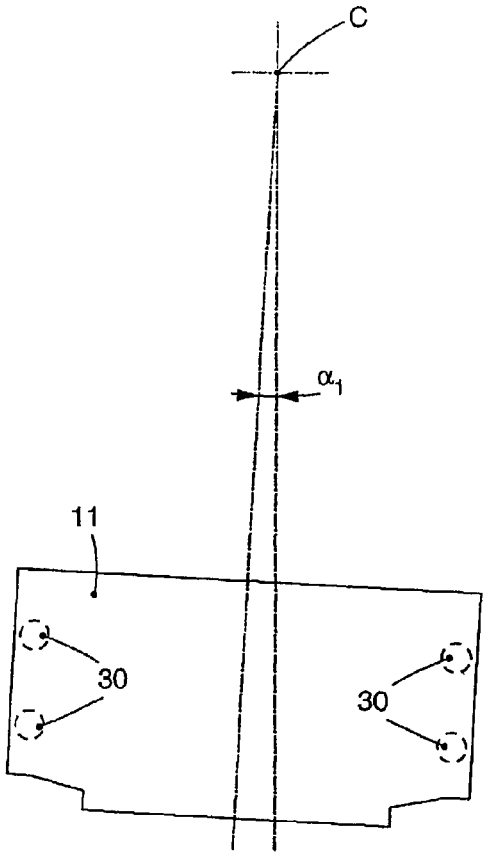
FIGS. 2*a* and 2*b* are schematic views of two different working positions of the device shown in FIG. 1.
Figure 2B:
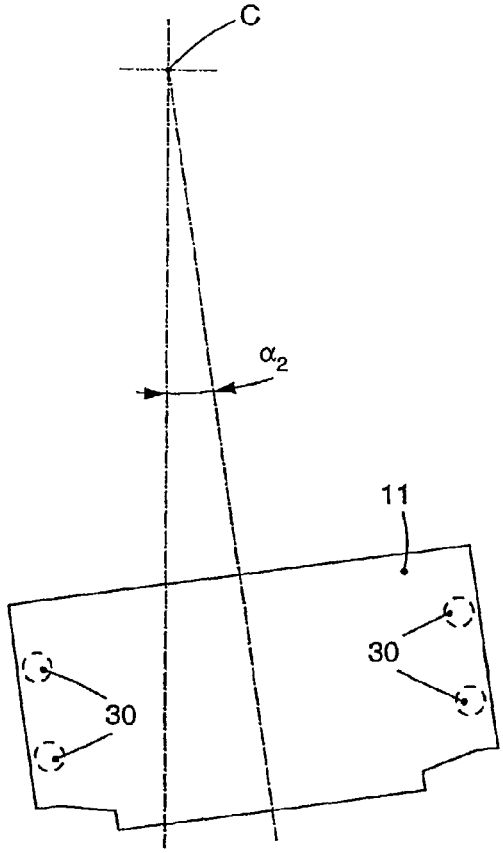
Figure 3:
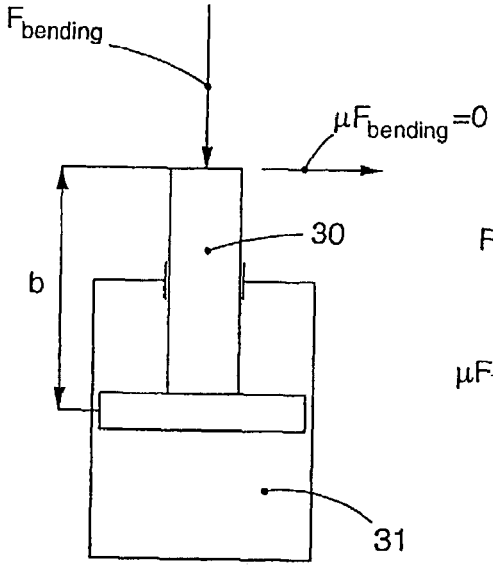
FIG. 3 is a schematic view of a first detail of the device in FIG. 1.

FIG. 1 is a view from above of a terminal part of the rolling roll 10, which can be a working roll or an intermediate roll, with the relative chock 11. The other terminal part of the roll 10 is substantially specular.

Said terminal part cooperates with the housing 12 of the rolling stand which has the intermediate compartment 13 vertical, where the chock 11 is housed.

On the chock 11, on one side and the other of the crossing plane of the roll 10, two drawing sectors 14*a* and 14*b* are provided.

The drawing sectors 14*a* and 14*b* in this case cooperate with a seating 15 in the housing 12, equipped with anti-friction sliding cylindrical surfaces 16, the radii r of which have their center at a point C arranged along the axis of rotation Y of the roll 10 and in correspondence with the center line of the latter.

On every side of the chock 11, and in coordination with the respective drawing sector 14*a*, 14*b* there is a drive means 17*a* and 17*b* which, in this case, is connected to an actuator consisting of a hydraulic cylinder jack 18*a* and 18*b*. The jack 18*a*, 18*b* can also be of the electric or electro-mechanical type.

Each jack 18*a*, 18*b* is connected to a position transducer 19*a* and 19*b*.

Figure 5:
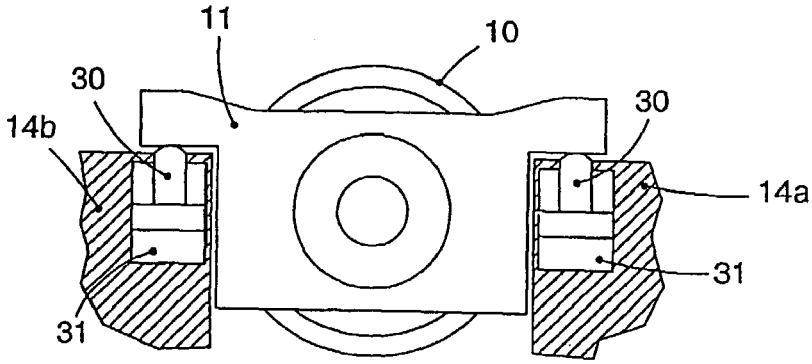
FIG. 5 is a section from A to A of FIG. 1.

With each chock 11 four bending rolls 30 can advantageously be associated; these can be actuated by any conventional means, for example by jacks 31 located in the drawing sectors 14*a* and 14*b* (FIG. 5). The jacks 31 can be single effect (of the IN or OUT type, or the IN+OUT type), or double effect, with a hammer head.

According to the invention, also the chock 11 or other part of the chock-roll assembly, is equipped with a position transducer 20.

The various transducers 19*a*, 19*b* and 20 located in relation to the two housings 12—chocks 11 are connected to a processing unit 21 which, by means of electro-valves 32 or similar, governs the position of the jacks 18*a*, 18*b* and therefore of the drive means 17*a*, 17*b*.

The drive means 17*a*, 17*b* are connected to the respective drawing sector 14*a*, 14*b* by two levers 22 oscillating in the stoppers 23 and 24.

Figure 4:
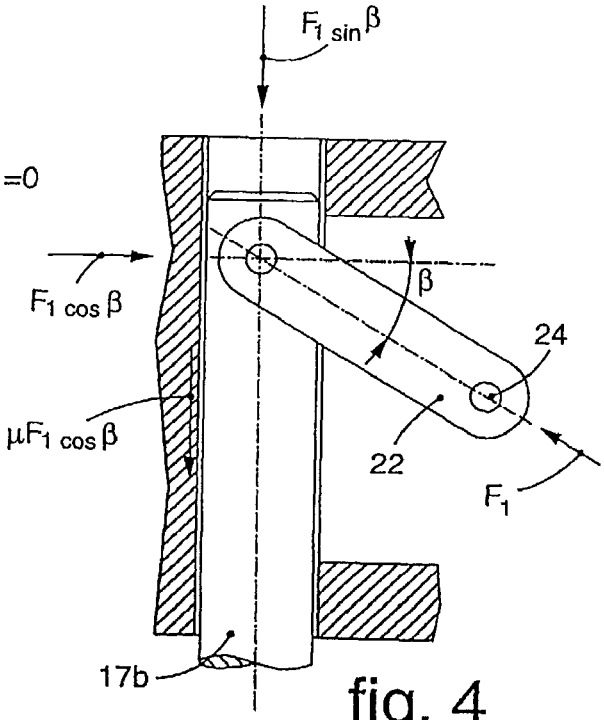
FIG. 4 is a schematic view of a second enlarged detail of the device in FIG. 1.

The two levers 22, in this case, are inclined with respect to the normal to the nominal axis of the roll 10, by an angle β (FIG. 4) of between about 10° and 45°, advantageously between about 15° and 30°.

According to the invention, the drawing sectors 14*a*, 14*b* and the facing associated chocks 11 of the same roll 10 move in arcs of a circle with their center at C.

The crossing of the roll 10 is made by means of four drawing sectors 14*a*, 14*b*, two for each chock 11, (only two are shown in FIG. 1), which are guided in their arched displacement, by the cylindrical guides 16 arranged concentric with the axis of rotation passing through the point C and perpendicular to the axis Y. The displacements of the four sectors 14*a*, 14*b* are antisymmetric and two by two, of the opposite sign on the two chocks 11 and of the same entity.

In this case, each jack 18*a*, 18*b* is arranged parallel to the axis of rotation Y of the roll 10. Each jack 18*a*, 18*b* is able to axially displace the corresponding drive means 17*a*, 17*b* consisting of a pin guided prismatically on the housing 12.

Each lever 22, hinged on the pin 17*a*, 17*b* and the sector 14*a*, 14*b*, as its angular lay-out varies, is able to displace the latter in the arc of a circle. The crossing of the roll 10 around the nominal axis Y, with center at C, is obtained by coordinating the actuation of the four jacks 18*a*, 18*b* which are controlled in position by the respective transducers 19*a*, 19*b*.

The angular position of each lever 22 is such as to generate on the actuator an axial thrust $F_1\sin\beta$ (FIG. 4) of more than $\mu F_1\cos\beta$ and of a value such as to be detected by the system which controls the actuator. That is to say: $F_1\sin\beta>\mu F_1\cos\beta$ or $\mathrm{tg}\beta>\mu$ with a margin such that the residual force on the actuator ($F_1\sin\beta-\mu F_1\cos\beta$) has values such as to be detected by the actuator (that is, to make the actuator yield).

Otherwise there is a risk of "breaking" the lever 22 or other elements of the kinematic chain, like the pins or otherwise.

Thanks to the fact that the drawing sectors 14*a* and 14*b* move in arcs of a circle with the center at C, and that the chock 11 also moves in arcs of circle with the center at C, the bending rolls 30 never slide with respect to the chock 11, with the advantages explained above. In this way, moreover, the roll 10 can be crossed with the bending forces kept applied; it is therefore not necessary to reduce the bending forces to zero before crossing the roll 10, whether it be a working roll or an intermediate roll.

It is obvious that modifications or additions can be made to the device as described heretofore without departing from the spirit and scope thereof. It is also obvious that, although the description refers to a specific example, a skilled person shall certainly be able to achieve many other equivalent applications of the device described above, all of which shall come within the field and scope of this invention.

What is claimed is:

1. A device to vary the positioning of at least a rolling roll for plane products, wherein said rolling roll has a nominal axis of rotation (Y), comprising:

two chocks for rotatably supporting said rolling roll, a housing to support said two chocks, drive means for crossing said rolling roll along a crossing plane passing through said nominal axis of rotation (Y), wherein said drive means has a linear axis of displacement substantially parallel to said nominal axis of rotation (Y) of said rolling roll, at least one drawing sector disposed on each lateral side of each of said two chocks for cooperating with said drive means, a transmitter element disposed in an intermediate position between said drawing sector and said drive means to achieve an oscillating connection between said drawing sector and said drive means, position transducer associated with said drive means, and data processor associated with said drive means.

2. Device as in claim 1, wherein at least a portion of said drive means is disposed outside said housing.

3. Device as in claim 2, wherein said drawing sector is moveable according to a curve passing through the vertical axis of said two chocks.

4. Device as in claim 1, wherein said drawing sector is able to move according to a curve passing through the vertical axis of said two chocks.

5. Device as in claim 4, wherein said curve comprises an arc of a circle with the center at a point (C) arranged along said nominal axis of rotation (Y) and in correspondence with the center line of said rolling roll.

6. Device as in claim 5, comprising four said drawing sectors, said four drawing sectors provided as two drawing sectors for each of said two chocks, and cylindrical guides for guiding said drawing sectors in their displacement along said curve respectively, said cylindrical guides having an axis of rotation passing through said point (C) and perpendicular to said nominal axis of rotation (Y) of said rolling roll.

7. Device as in claim 6, wherein the displacements of said four drawing sectors are two by two and antisymmetric, of the opposite sign on said two chocks and of equal entity.

8. Device as in claim 7, wherein said drive means comprise, for each of said four drawing sectors, a jack arranged parallel to said nominal axis of rotation (Y) of said rolling roll and a prismatic pin guided on a prismatic guide of said housing.

9. Device as in claim 8, wherein said transmitter element comprises a lever hinged on said pin and on the corresponding drawing sector and able, as angular lay-out of the lever varies, to displace said drawing sector according to said arc of a circle.

10. Device as in claim 9, wherein each lever is inclined, with respect to a line perpendicular to said nominal axis of rotation (Y) of said rolling roll, by an angle (β) of between about 10° and 45°.

11. Device as in claim 10, wherein each lever is inclined, with respect to a line perpendicular to said nominal axis of rotation (Y) of said rolling roll, by an angle (β) of between about 15° and 30°.

12. Device as in claim 1, wherein said drawing sector contains actuating means to actuate a bending of said rolling roll, to maintain every bending force applied by said actuating means to actuate said bending of said rolling roll during said crossing of said rolling roll along said crossing plane.

13. Device as in claim 12, wherein said actuating means comprise at least a jack positioned in said drawing sector.

14. Device as in claim 13, wherein said jack has a single effect, either of the IN or OUT type, or of the IN plus OUT type.

15. Device as in claim 13, wherein said jack has a double effect, with a hammer head.

* * * * *